US006638027B2

(12) United States Patent
Mohrmann

(10) Patent No.: US 6,638,027 B2
(45) Date of Patent: Oct. 28, 2003

(54) HYBRID COMPRESSOR WITH BEARING CLUTCH ASSEMBLY

(75) Inventor: Robert J. Mohrmann, Pinckney, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/014,723

(22) Filed: Dec. 11, 2001

(65) Prior Publication Data

US 2003/0108434 A1 Jun. 12, 2003

(51) Int. Cl.[7] ..... F04B 49/00; F04B 17/00

(52) U.S. Cl. ..... 417/223; 417/374; 417/362; 417/364

(58) Field of Search ..... 417/223, 374, 417/362, 315, 316, 319, 364, 451

(56) References Cited

U.S. PATENT DOCUMENTS 2,281,626 A * 5/1942 Smith ..... 62/203
2,683,420 A 7/1954 Hill et al.
2,902,205 A * 9/1959 Parker ..... 417/319
3,211,365 A 10/1965 Phelps
3,789,618 A * 2/1974 Feliz ..... 62/236
3,941,012 A * 3/1976 Mayer ..... 74/661
4,087,204 A 5/1978 Niedermeyer
4,293,281 A * 10/1981 Lamoreaux ..... 417/9
4,475,872 A 10/1984 Foughty
4,697,991 A 10/1987 Tsukahara et al.
4,900,231 A 2/1990 Kennedy
5,867,996 A * 2/1999 Takano et al. ..... 62/175
6,247,899 B1 * 6/2001 Ban et al. ..... 417/16

* cited by examiner

*Primary Examiner*—Cheryl J. Tyler
*Assistant Examiner*—Timothy P. Solak
(74) *Attorney, Agent, or Firm*—Brinks Hofer Gilson & Lione

(57) ABSTRACT

A hybrid compressor having a driveshaft driven by a plurality of drive sources for a vehicle air-conditioning system. More specifically, the drive sources are the vehicle engine coupled to the compressor via a belt driven clutch and an electric motor driving the compressor. A bearing clutch couples the electric motor to the driveshaft.

12 Claims, 2 Drawing Sheets

HYBRID COMPRESSOR WITH BEARING CLUTCH ASSEMBLY

TECHNICAL FIELD OF THE INVENTION

The present invention relates to a hybrid refrigerant compressor mainly used for motor vehicle air-conditioning systems.

BACKGROUND OF THE INVENTION

The present invention pertains to a hybrid refrigerant compressor having a driveshaft driven by a plurality of drive sources. The drive sources include a belt driven pulley powered by the vehicle's prime mover engine and an electric motor that can drive the air-conditioning system compressor when the vehicle engine is not operating.

Generally, a vehicle air-conditioning system includes a refrigeration circuit which includes a compressor and an external circuit connected to the compressor. When the compressor is driven by the engine, refrigerant circulates in the refrigeration circuit and cools the passenger compartment. Typically, the compressor is connected to a single drive source; namely, the vehicle's engine, driving a belt wrapped on a pulley with an electromagnetic clutch. When the cooling capacity of the refrigeration circuit becomes excessive as the thermal load on the refrigerator circuit decreases, the electromagnetic clutch is de-energized and the operation of the compressor is temporarily stopped. When the engine has stopped, the compressor is not operated and the cooling function is stopped whether the electromagnetic clutch is turned on or off. When the engine is stopped, the compressor can be driven by the motor to cool the passenger compartment. This is a particular problem in so-called hybrid vehicles, in which the prime mover engine may generate electricity to drive electric motors with energy from storage batteries. These vehicles may have operating modes in which cooling is required when the engine is not operated.

Current hybrid compressors use a common shaft through the compressor either driven from the front by the belt driven pulley or the rear by an electric motor. Upon engagement, the electromechanical clutch attached to the front of the compressor must overcome the momentum of not only the compressor but also the momentum of the rotor of the electric motor. This puts high loads on the compressor drive shaft and the clutch, and causes an engine rpm drop. The compressor controls must also manage the transient electricity produced by the drive motor while the compressor is being driven by the belt driven pulley.

BRIEF SUMMARY OF THE INVENTION

In this invention a bearing clutch assembly interacts with the rotor of the electric motor that allows the motor to drive the driveshaft or let it freewheel. By doing this, the rotor is supported on the bearing assembly during the belt driven pulley operation and the momentum of the rotor is not seen by the clutch being driven from the engine. When the compressor is powered from the electric motor, the bearing clutch is engaged, enabling the compressor to be turned via the electric motor.

Other aspects and advantages of the invention will become apparent from the following description taken in conjunction with the accompanying drawings, illustrating by way of example the principles of the invention.

BRIEF DESCRIPTION OF THE DRAWINGS

The feature of the present invention that are believed to be novel are set forth with particularity in the appended claims.

The invention, together with objects and advantages thereof, may best be understood by reference to the following description of the presently preferred embodiments together with the accompanying drawings in which.

DETAILED DESCRIPTION OF THE PREFERRED EMBODIMENT

The foregoing discussion discloses and describes a preferred embodiment of the invention. One skilled in the art will readily recognize from such discussion and from the accompanying drawings and claims that changes and modifications can be made to the invention without departing from the true spirit and fair scope of the invention as defined in the following claims. The invention has been described in an illustrative manner and it is to be understood that the terminology that has been used is intended to be in the nature of words of description rather than of limitation.

Figure 1:
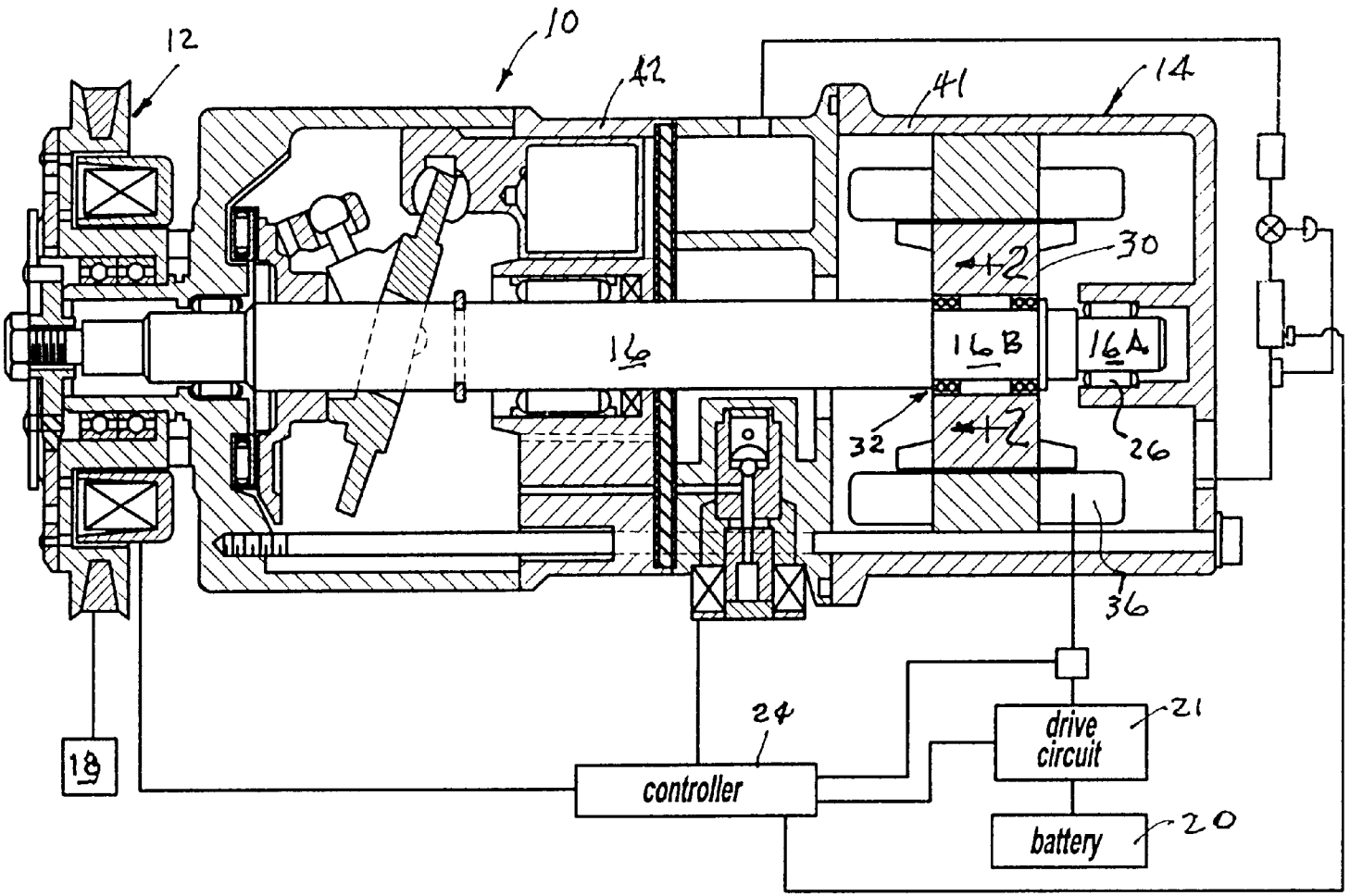
FIG. 1 is a cross-sectional view showing a hybrid compressor according to one embodiment of the present invention.

A hybrid compressor according to one embodiment of the present invention will now be described with references to FIGS. 1 through 3, inclusive. FIGS. 1 and 3 show the hybrid compressor 10, and the pulley and electromagnetic clutch 12 and electric motor 14. The clutch 12 is attached to the front of the compressor 10. The electric motor 14 is attached to the rear of the compressor 10. The clutch 12 is attached to one end of a driveshaft 16 and selectively transmits power of a vehicle engine 18 to the driveshaft 16. The electric motor 14 is powered by DC power source which is a battery 20 and is positioned at the opposite end of driveshaft 16 as clutch 12. A drive circuit 21 controls the supply of electric power from the battery 20 to the clutch 12 in accordance with instructions from a controller 24. An electric current sensor (not shown) detects the value of the electric power supplied to the motor.

The electric motor 14 is shown in FIG. 1 along with a motor housing 41 joined to the rear of the housing 42 for the compressor 10. The rear end of the driveshaft 16 passes through the rear housing of the compressor 10, and terminates in the motor housing 41. The part of the driveshaft 16 located in the motor housing 41 includes sections 16A and 16B. The end 16A of the output shaft is supported by a radial bearing 26. A rotor 30 of electric motor 14 is mounted to driveshaft 16 by a bearing clutch 32 at the driveshaft section 16B.

Figure 2:
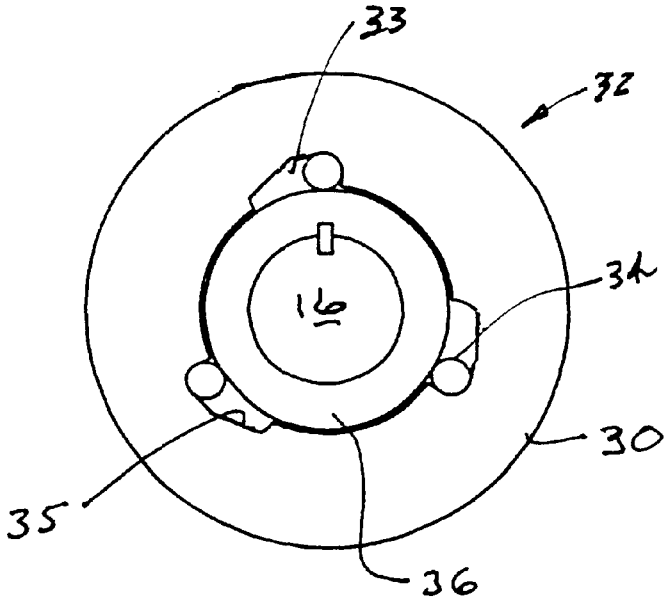
FIG. 2 is a cross-sectional view taken on line 2—2 of FIG. 1 and showing the bearing clutch.
Figure 3:
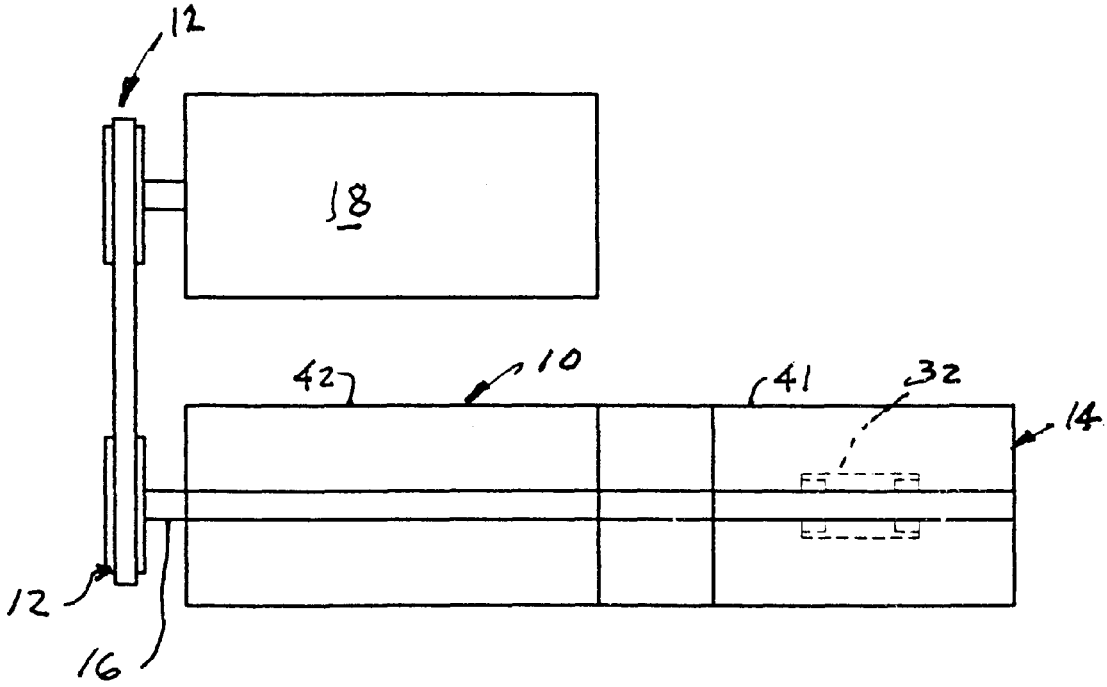
FIG. 3 is a block diagram illustrating the compressor, the motor, and the vehicle engine.

The bearing clutch 32 is shown in detail in FIG. 2 as having a plurality of angularly spaced inclined notches 33 formed by stator 30, acting as an outer race in which are positioned rollers 34. An inner race 36 is coupled to driveshaft 16. When the driveshaft 16 turns clockwise, the rollers 34 will be wedged in the notches 33 so the rollers 34 rolls with the shaft 16. Thus, with respect to the orientation in FIG. 2 when the driveshaft 16 is being driven clockwise, the rollers 34 will roll freely in the notches 33 and torque will not be transmitted to rotor 30. As a result, when the engine 18 is driving the driveshaft 16, the rotor 30 will remain at rest (or rotate slowly). Conversely, during when the engine 18 is not driving the shaft 16, the electric motor 14 is utilized to operate the compressor 10 causing the driveshafts 16 to be driven counter-clockwise, causing rollers 34 to wedge along ramps 35. In that operating condition, rollers 34 ride along ramp surfaces 35 and the rotor 30 becomes locked to the shaft 16 and they rotate together.

Attachment of the rotor 30 to the compressor shaft 16 through the bearing clutch assembly 32 enables the rotor 30 to slip with respect to the shaft through bearing clutch assembly 32 that occurs during operation of the internal combustion engine 18 and momentum of the rotor 30 is not seen by the clutch being driven from the engine 18. When the compressor 10 is powered from the electric motor 14, the bearing clutch 32 is engaged to the compressor shaft 16 by the nature of the rotor 30 turning and the compressor is then turned via the electric motor 14.

It should be recognized that the design of bearing clutch assembly 32 is only one of many known one-way bearing clutch designs. Other designs could be implemented so long as driveshaft 16 can freely rotate with respect to rotor 30 in one rotational direction, and they become engaged to rotate together in the other direction. Also, the functions of supporting driveshaft 16 for rotating could be provided by a separate bearing, and the clutching function served by a separate clutch device.

One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology that has been used is intended to be in the nature of words of description rather than of limitation.

We claim:

1. A system for controlling a motor vehicle climate, the system comprising:

a compressor that is selectively driven by an engine of the motor vehicle, wherein the compressor has a driveshaft connected to the engine;

an electric motor having a rotor;

a controlable clutch to selectively engage the engine with the driveshaft; and a one way clutch to selectively engage the motor with the driveshaft when the controllable clutch is deactivated and the rotor is driven by the motor, and to selectively disengage the motor from the driveshaft when the controllable clutch is activated and the driveshaft is driven by the engine.

2. The system according to claim 1 wherein the electric motor includes a rotor concentrically positioned around the driveshaft.

3. The system according to claim 2 wherein the one way clutch is positioned on the outside of the driveshaft and the rotor radially surrounds the one way clutch.

4. The system according to claim 1 wherein the controllable clutch is positioned at one end of the driveshaft and the electric motor is positioned at an opposite end of the driveshaft.

5. The system according to claim 4 wherein the controllable clutch is electromagnetically actuated and is coupled to the engine by a belt driven pulley.

6. The system according to claim 1 wherein the one way clutch is a roller clutch that includes an inner race, an outer race, and a plurality of roller elements therebetween, the inner and outer races forming pockets which enable the roller elements to rotate to allow free rotation of the driveshaft with respect to the stator in one direction of relative rotation, and to prevent rotation in an opposite direction of relative rotation.

7. A hybrid refrigeration compressor for a motor vehicle climate control system that is selectively driven by a prime mover engine of the motor vehicle and an electric motor, comprising:

the compressor having a driveshaft connected to the engine through a belt driven controllable clutch positioned at one end of the driveshaft and connected to the electric motor which includes a rotor overfitting the driveshaft adjacent a second opposite end of the driveshaft, and a one way roller clutch positioned between the driveshaft and the rotor causing the driveshaft to be engaged with the rotor when the motor is energized to apply torque to the driveshaft and being disengaged when the controllable clutch is energized to apply torque from the engine to the compressor.

8. The hybrid refrigeration compressor according to claim 7 wherein the controllable clutch is eletromagnetically actuated and is coupled to the engine by a belt driven pulley.

9. The hybrid refrigeration compressor according to claim 8 wherein the one way roller clutch includes an inner race, an outer race, and a plurality of roller elements therebetween, the at least one of the inner and outer races forming pockets which enable the roller elements to rotate to allow free rotation of the driveshaft with respect to the stator in one direction of relative rotation, and to prevent rotation in an opposite direction of relative rotation.

10. A hybrid refrigeration compressor for a motor vehicle climate control system that is selectively driven by a prime mover engine of the motor vehicle and an electric motor, comprising:

the compressor having a driveshaft connected to the engine through a controllable clutch and connected to the electric motor, wherein the electric motor includes a rotor concentrically positioned around the driveshaft; and a one way clutch causing the driveshaft to be engaged with the motor when the motor is energized to apply torque to the driveshaft and being disengaged when the controllable clutch is energized to apply torque from the engine to the compressor, wherein the one way clutch is positioned on the outside of the driveshaft and the rotor radially surrounds the one way clutch.

11. A hybrid refrigeration compressor for a motor vehicle climate control system that is selectively driven by a prime mover engine of the motor vehicle and an electric motor, comprising:

the compressor having a driveshaft connected to the engine through a controllable clutch and connected to the electric motor, and a one way clutch causing the driveshaft to be engaged with the motor when the motor is energized to apply torque to the driveshaft and being disengaged when the controllable clutch is energized to apply torque from the engine to the compressor, where the controllable clutch is positioned at one end of the driveshaft and the electric motor is positioned at an opposite end of the driveshaft.

12. The hybrid refrigeration compressor according to claim 11 wherein the controllable clutch is electromagnetically actuated and is coupled to the engine by a belt driven pulley.

* * * * *